US009927168B2

(12) United States Patent
Khizar et al.

(10) Patent No.: US 9,927,168 B2
(45) Date of Patent: Mar. 27, 2018

(54) PASSIVE ILLUMINATION SYSTEM FOR APPLIANCES

(71) Applicant: Whirlpool Corporation, Benton Harbor, MI (US)

(72) Inventors: Muhammad Khizar, St. Joseph, MI (US); Vincent D. Csapos, Hamilton, MI (US); Charles R. Cravens, St. Joseph, MI (US); David Edwards, South Bend, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 200 days.

(21) Appl. No.: 14/665,186

(22) Filed: Mar. 23, 2015

(65) Prior Publication Data

US 2016/0281959 A1 Sep. 29, 2016

(51) Int. Cl.

| | |
|---|---|
| ***F21V 7/22*** | (2006.01) |
| ***F21V 33/00*** | (2006.01) |
| ***F25D 27/00*** | (2006.01) |
| ***A47L 15/24*** | (2006.01) |
| ***F25D 23/06*** | (2006.01) |

(52) U.S. Cl.

CPC ..... *F25D 27/00* (2013.01); *A47L 15/241* (2013.01); *F25D 23/066* (2013.01)

(58) Field of Classification Search

CPC .. F21V 7/22; F21V 33/0044; F21W 2131/305
See application file for complete search history.

(56) References Cited

U.S. PATENT DOCUMENTS

| | | | | |
|---|---|---|---|---|
| 4,971,841 | A * | 11/1990 | Panush | B05D 5/068 427/407.1 |
| 6,041,610 | A | 3/2000 | Edwards et al. | |
| 7,588,340 | B2 * | 9/2009 | Bauer | F21V 33/0044 362/154 |
| 7,588,342 | B2 * | 9/2009 | Buelow, II | A47F 3/001 362/125 |
| 7,984,997 | B1 * | 7/2011 | Sandberg | F25D 27/005 362/101 |
| 8,327,657 | B2 * | 12/2012 | Min | F25D 17/042 62/240 |
| 8,720,219 | B1 | 5/2014 | Sheik-Bahae | |
| 2011/0277493 | A1 * | 11/2011 | Becke | F25D 27/00 62/264 |
| 2012/0047934 | A1 * | 3/2012 | Park | F25D 17/062 62/264 |

(Continued)

FOREIGN PATENT DOCUMENTS

| | | | |
|---|---|---|---|
| GB | 2501053 | A | 10/2013 |
| WO | 2013026778 | A1 | 2/2013 |

*Primary Examiner* — Elmito Breval
(74) *Attorney, Agent, or Firm* — Price Heneveld LLP

(57) ABSTRACT

A refrigeration appliance has a cabinet defining a refrigeration compartment with a thermoformed inner liner disposed within the refrigeration compartment. A light source is located within the refrigeration compartment and configured to emit light such that the refrigeration compartment is illuminated when the light source is powered. The thermoformed liner has a reflective surface. The reflective surface includes a plurality of microcrystalline structures and is positioned to reflect emitted light from the light source and ambient light.

7 Claims, 6 Drawing Sheets

(56) References Cited

U.S. PATENT DOCUMENTS

2012/0085116 A1* 4/2012 Maeng ..... F25D 17/042
62/264
2013/0033854 A1* 2/2013 Statham ..... F25D 27/00
362/154

* cited by examiner

PASSIVE ILLUMINATION SYSTEM FOR APPLIANCES

FIELD OF THE DISCLOSURE

The present disclosure generally relates to an illumination system for appliances. More specifically, the present disclosure generally relates to passive coatings and films for reflecting light and enhancing aesthetics within appliances.

SUMMARY OF THE DISCLOSURE

According to one aspect of this disclosure, a refrigeration appliance has a cabinet defining a refrigeration compartment with a thermoformed inner liner disposed within the refrigeration compartment. A light source is located within the refrigeration compartment and configured to emit light such that the refrigeration compartment is illuminated when the light source is powered. The thermoformed liner has a reflective surface. The reflective surface includes a plurality of microcrystalline structures and is positioned to reflect emitted light from the light source and ambient light.

According to another aspect of this disclosure, an appliance has an appliance cabinet defining a storage compartment. A surface is disposed within the storage compartment of the appliance cabinet and a light source is configured to transmit emitted light of a substantially visible wavelength into the storage compartment of the appliance cabinet. A reflective coating is disposed on the surface. The reflective coating is configured to reflect greater than about 90% of the emitted light contacting the reflective coating as diffuse reflected light where multiple emissions exit the reflective coating in random directions.

According to yet another aspect of this disclosure, a method of making a liner for an appliance includes steps of extruding a polymeric material comprising a thermoplastic polymer, rolling the polymeric material into a substantially flat sheet, and heating a film comprising a plurality of microcrystalline structures. The film is configured to reflect greater than about 90% of light contacting the reflective coating as diffused reflected light where multiple emissions occur in random directions. Next the film is bonded to at least one surface of the sheet and the sheet is thermoformed into the liner for an appliance.

These and other features, advantages, and objects of the present disclosure will be further understood and appreciated by those skilled in the art by reference to the following specification, claims, and appended drawings.

DETAILED DESCRIPTION

It is to be understood that the present disclosure is not limited to the particular embodiments described below, as variations of the particular embodiments may be made and still fall within the scope of the appended claims. It is also to be understood that the terminology employed is for the purpose of describing particular embodiments, and is not intended to be limiting. Instead, the scope of the present disclosure will be established by the appended claims.

Figure 1:
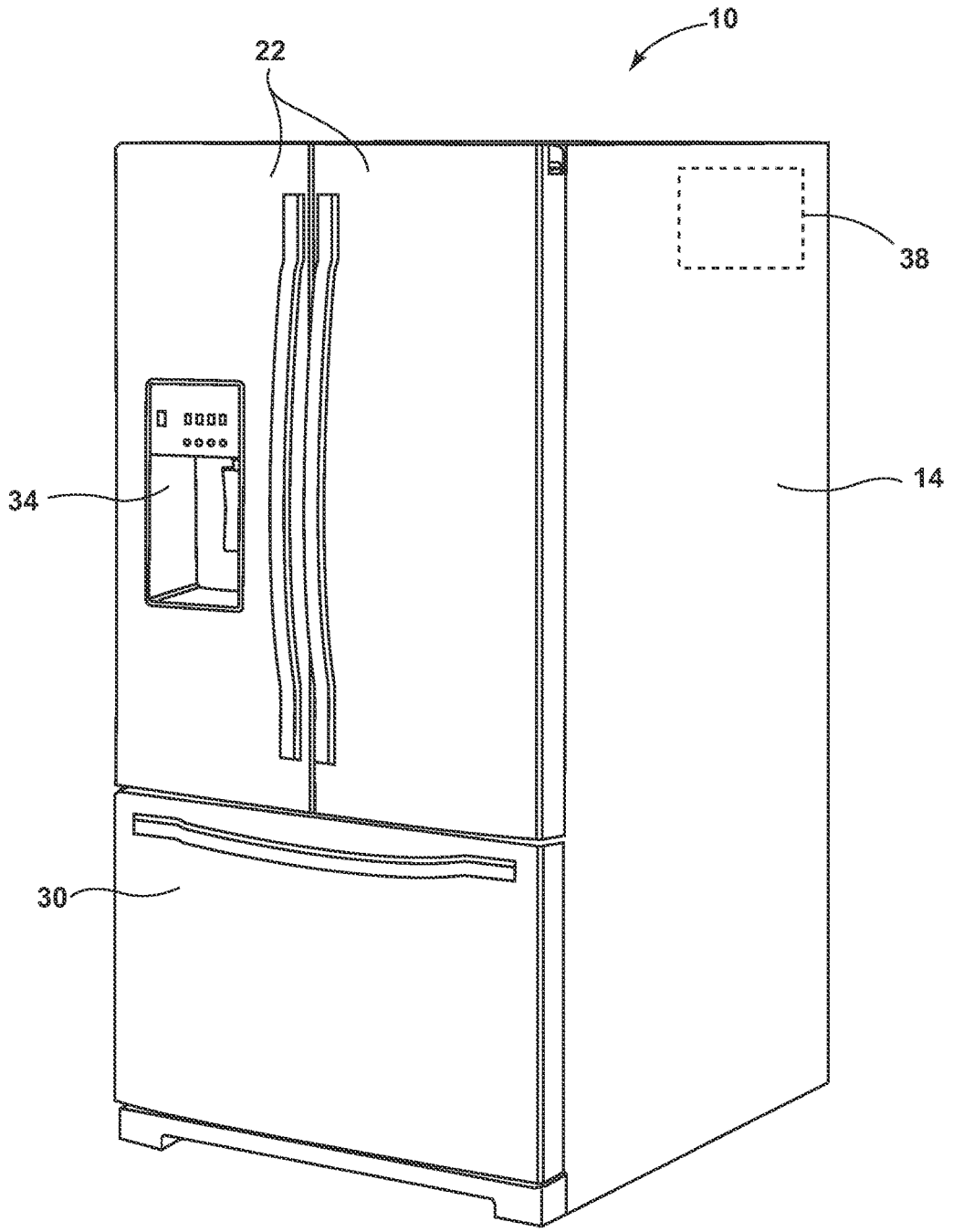
FIG. 1 is a front perspective view of a refrigerating appliance according to one embodiment.

For purposes of description herein, the terms "upper," "lower," "right," "left," "rear," "front," "vertical," "horizontal," and derivates thereof shall relate to a refrigerating appliance 10 as oriented in FIG. 1, unless stated otherwise. However, it is to be understood that the refrigerating appliance 10 may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

By way of illustration, FIGS. 1-4 provide exemplary features, aspects and embodiments for a refrigeration appliance 10. The refrigeration appliance 10 includes a cabinet 14 defining a refrigeration compartment 18 selectively closeable by at least one, but in the refrigerator cabinet shown (a French door bottom mount configuration) a pair of refrigeration compartment doors 22 and a freezer compartment 26 selectively closeable by a freezer compartment door 30. A dispenser 34 may be included a refrigeration compartment door 22 or freezer compartment door 30 for dispensing liquid and/or ice. The refrigeration compartment 18 and the freezer compartment 26 act as storage compartments within the cabinet 14. A refrigeration system 38, which is typically a vapor compression refrigeration system, is included in the refrigeration appliance 10 to control the temperature with the refrigeration compartments 18 and freezer compartments 26. Although one particular design of the refrigeration appliance 10 is shown in FIG. 1 and replicated throughout various figures of the present disclosure, other refrigerator styles and configurations are contemplated. For example, the refrigeration appliance 10 could be a side-by-side refrigeration appliance, a refrigeration appliance with the freezer compartment positioned above the refrigeration compartment (top-mount refrigerator), a refrigeration appliance that includes only a refrigeration compartment and no freezer compartment, a chest freezer, etc. In FIG. 1, a French door bottom-mount refrigeration appliance 10 is shown where the freezer compartment 26 is located below the refrigeration compartment 18.

Figure 2:
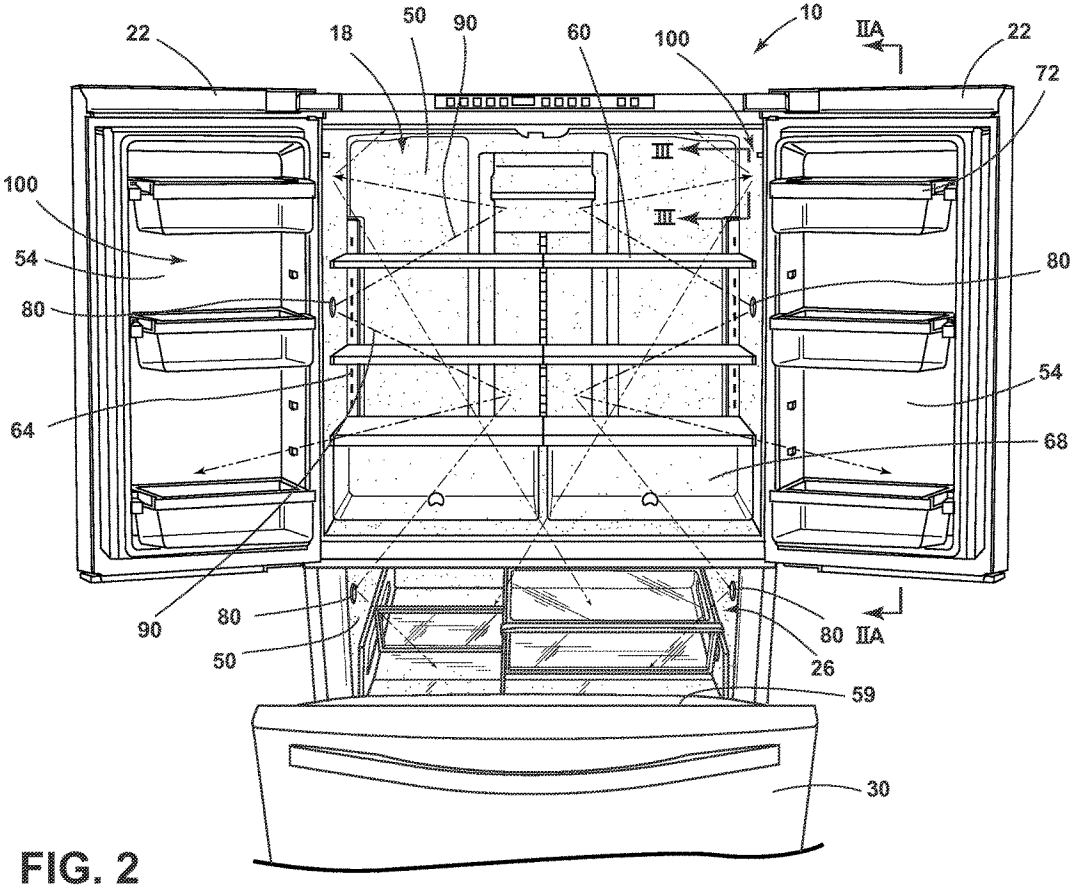
FIG. 2 is a front perspective view of a refrigerating appliance in an open state according to a further embodiment.

Referring now to FIG. 2, an appliance cabinet liner 50, which is visible to the user when the door(s) of the appliance is open, is disposed within the refrigeration compartment 18 and the freezer compartment 26. In the depicted embodiment, the liner 50 is a single unitary piece; however, in other embodiments the appliance cabinet liner 50 may be separated into a refrigeration compartment 18 portion and a freezer compartment 26 portion or subdivisions thereof. Door liners 54, which are separate from the appliance cabinet liner 50, are located on the refrigeration compartment doors 22 and the freezer compartment door 30. The appliance cabinet liner 50 and door liners 54 typically include a thermoplastic such as high impact polystyrene, but may include a wide variety of other polymeric materials, as well as metals and ceramics. The liners 50, 54 may include pigments or dyes configured to increase the reflectivity of light within the refrigeration compartment 18 and freezer compartment 26, or to help color the light (e.g., white, green, blue, or red). When constructed of polymeric material such as high impact polystyrene, the liners 50, 54 are typically extruded and then thermoformed, but may also be injection molded or formed using other known forming technologies.

Referring again to FIG. 2, the refrigeration appliance 10 includes four adjustable shelves 60 removably mounted within the refrigeration compartment 18, upon which a user of the refrigeration appliance 10 may arrange food items. The shelves 60 may comprise a polymer, a glass, a metal, or combinations thereof. It is contemplated that the refrigeration appliance 10 may include any number of adjustable shelves 60. In the depicted embodiment, the adjustable shelves 60 are removably mounted within the refrigeration compartment 18 to three shelf ladders 64 having a plurality of mounting positions. The shelf ladders 64 allow a user to remove any adjustable shelf 60 and relocate it to any available shelf mounting position within the refrigeration compartment 18. In the depicted embodiment, the refrigeration appliance 10 additionally includes drawers 68 and door bins 72 supporting or storing food within the refrigeration compartment 18. In addition to shelves, the refrigerator compartment may also employ drawers, bins, panels, nooks and the like devices that are configured to hold a comestible (food or beverage) item. It should be understood that the freezer compartment 26 may be similarly equipped with shelves, drawers, bins, and/or baskets.

Still referring to FIG. 2, one or more (a plurality) light sources 80 are typically located within both the refrigeration compartment 18 and the freezer compartment 26, but one compartment or the other or both may contain no light sources. In the depicted embodiment, two light sources 80 are located on opposite sides of the refrigeration compartment 18 and two light sources 80 are located in the freezer compartment 26. It should be understood that more or less light sources 80 (e.g., one, four, or five) may be included in the compartments 18, 26 and that light sources 80 may be placed in a variety of locations (e.g., above the shelves 60, in the drawers 68, on the door liners 54) without departing from the spirit of the disclosure. The light sources 80 are depicted as substantially circular, but may take a variety of shapes (e.g., square, rectangular, oval). The light sources 80 are configured to emit substantially visible light into the compartments 18, 26 such that foodstuffs or objects stored within the refrigeration appliance 10 are illuminated and visible to a user.

In operation, the light sources 80 are activated upon the opening of the refrigeration compartment door 22 or freezer compartment door 30 such that the refrigeration compartment 18 or the freezer compartment 26 is illuminated. In the depicted embodiment, light rays 90 emitted from the light sources 80 travel through the refrigeration compartment 18 and make contact with the liner 50 or the shelves 60. Additionally or alternatively, the light rays 90 may emanate from ambient sources external to the refrigeration appliance 10. For example, light rays 90 emitted from lighting systems or natural sources within an environment of the refrigeration appliance 10 may enter the refrigeration appliance 10 while the refrigeration compartment doors 22 and/or the freezer compartment door 30 are in a substantially open position and reflect within to illuminate the compartments 18, 26. Typically, the light rays 90 undergo multiple reflections within the refrigeration compartment 18 and freezer compartment 26 before finally being absorbed by the liner 50, shelves 60, or items stored inside the refrigeration appliance 10. The number of reflections the light rays 90 undergo directly relates to the perceived luminance of the refrigeration and freezer compartments 18, 26 by the user.

Figure 2A:
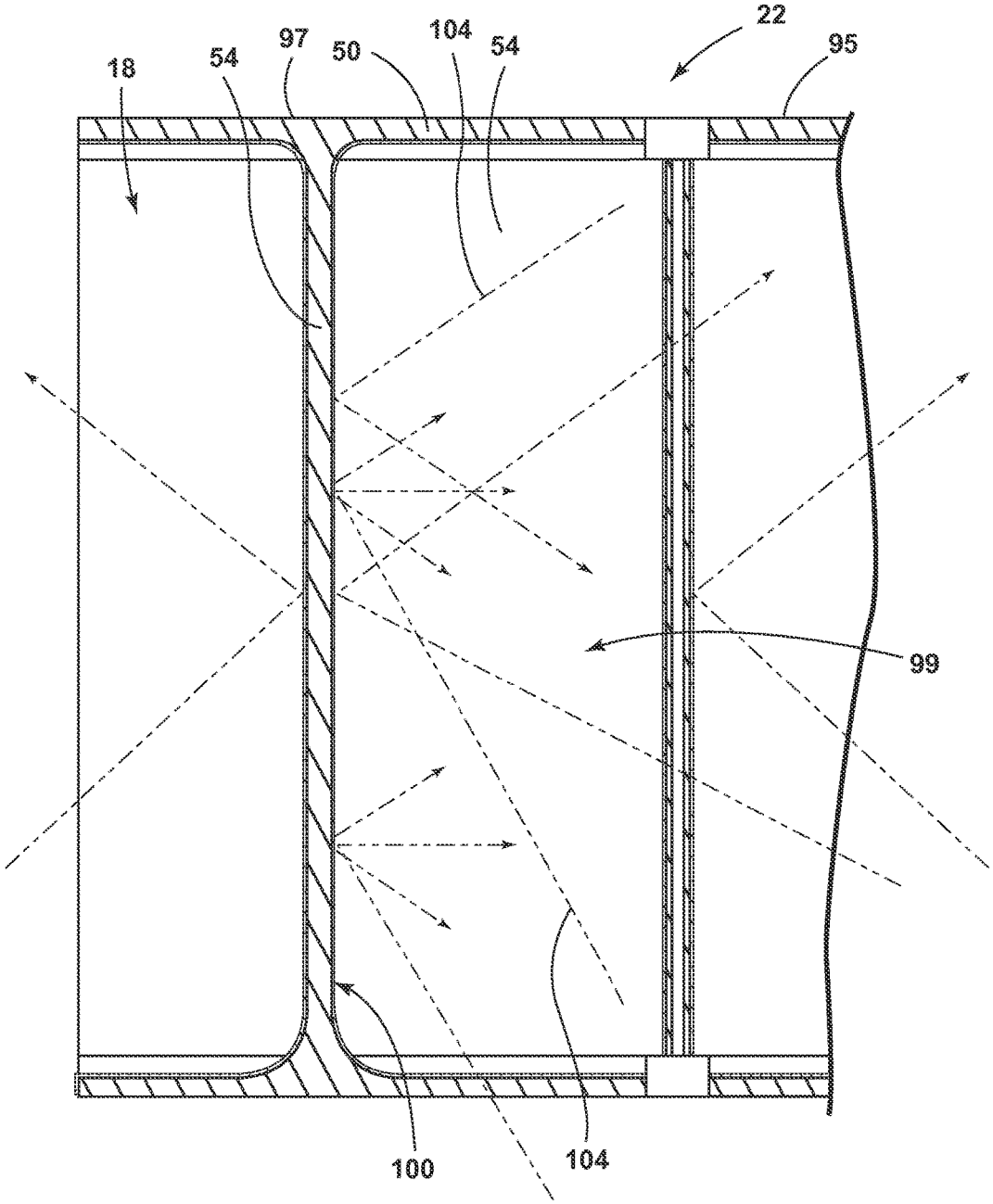
FIG. 2A is a cross sectional view along line IIA according to one embodiment.

Referring now to FIG. 2A, depicted is an embodiment of the doors 22 having a door-in-door configuration. In the door-in-door configuration, the door 22 includes an outer door portion 95 attached to an inner door portion 97 to define a door compartment 99. For clarity, the door compartment 99 and the door 22 are depicted without bins 72, however, the door compartment 99 may employ drawers, bins, panels, nooks and like devices in operation. The outer door portion 95 is configured to open away from the inner door portion 97 to allow access to the door compartment 99. When the door 22 is in the open position to expose the door compartment 99, ambient light from the surroundings of the refrigerating appliance 10 may enter the door compartment 99.

Figure 3A:
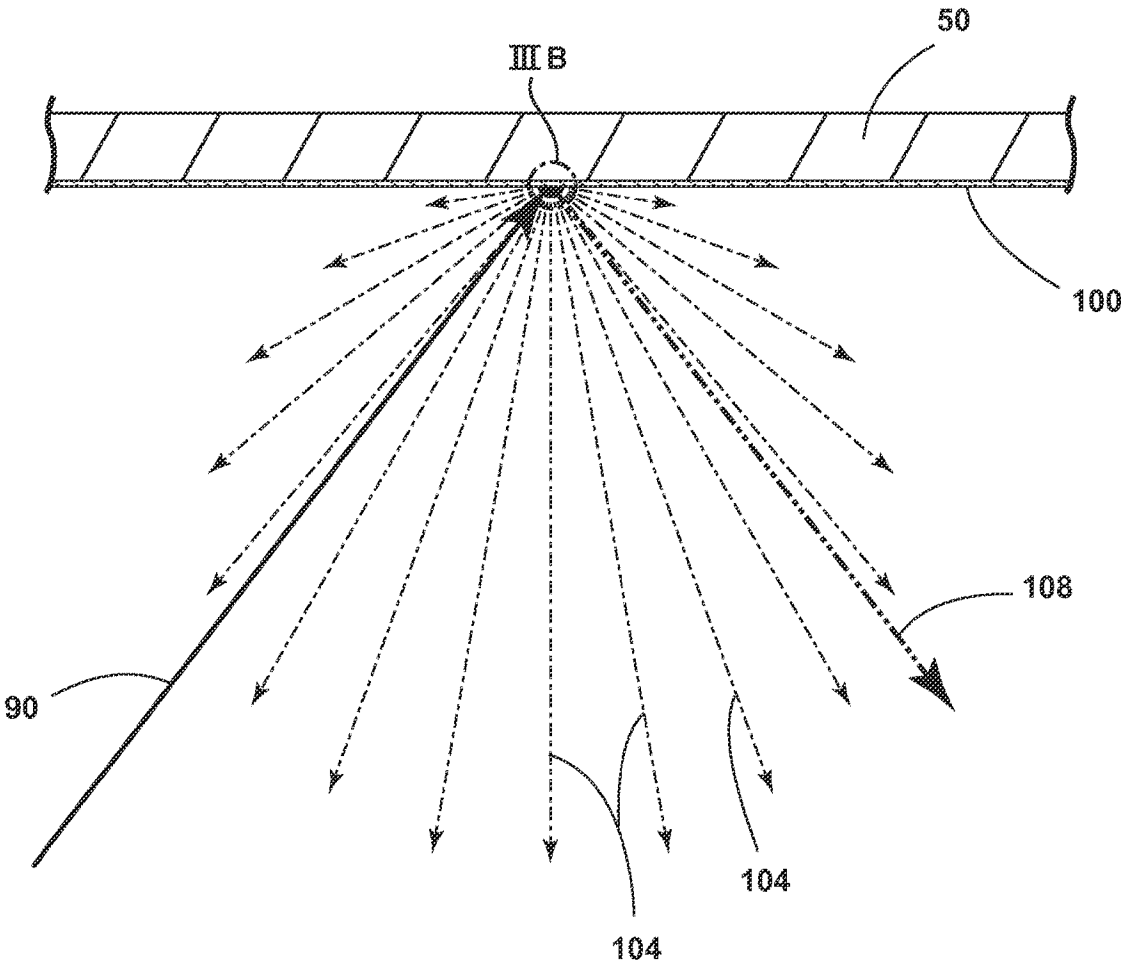
FIG. 3A is a cross-sectional side view FIG. 2 along line III according to one embodiment.

Referring now to FIG. 3A, the liner 50 of the refrigeration compartment 18, the door compartment 99 and/or the freezer compartment 26 has a reflective coating 100 applied thereto (FIG. 2). In additional embodiments, the door liners 54, the shelves 60, the drawers 68, and/or the door bins 72, may also have the reflective coating 100 applied thereto. The door compartment 99 (FIG. 2) may have the reflective coating 100 applied to both sides of the door liner 54. Depicted in FIG. 3 is a schematic representation of how the reflective coating 100 interacts with the light rays 90 emitted from the light source 80 and ambient sources. The reflective coating 100 is configured to emit a diffuse reflection 104 and a specular reflection 108 of light when light rays 90 contact the coating 100. A specular reflection of light produces a mirror like appearance because the light is reflected in a predictable and geometrically calculable way. A diffuse reflection differs from specular in that a diffuse reflection results in multiple secondary emissions exiting the reflective coating 100 in random directions. Such a diffuse reflection is desirable in a confined space because it scatters light which leads to a greater perceived illumination. Applicants have surprisingly discovered unexpected results that confined spaces, such as the refrigeration compartment 18, freezer compartment 26, and/or the door compartment 99, may be illuminated solely by the use of the reflective film 100 based on ambient lighting from the surroundings of the refrigerating appliance 10. In such an embodiment, minimal or no active lighting may be required to illuminate spaces within the refrigerating appliance 10. In some embodiments, the reflective coating 100 may be configured to emit only the diffuse reflection 108. The reflectivity of the coating 100 is defined as the total amount of light reflected from the coating 100, including both the diffuse reflection 104 and the specular reflection 108. The light rays 90 may originate from one of the light sources 80 or from a previous diffuse or specular reflection 104, 108.

In some embodiments, the reflective coating 100 has a reflectivity greater than about 90%. In other embodiments, the reflectivity of the reflective coating 100 is greater than about 95%. In further embodiments, the reflectivity of the coating 100 is greater than about 97%. The diffuse reflection 104 portion of the total reflection of the reflective coating 100 is at least 90%; in some embodiments, greater than 95%; and in further embodiments, greater than 97%. The reflective coating 100 substantially reflects light between 400 nm and 700 nm, but does not substantially (i.e. less than about 50%) reflect light below 400 nm (e.g., ultraviolet light). The reflective coating 100 may be between about 0.1 mm and 2.0 mm in thickness and may vary in thickness across the liner 50. It should be understood that the reflectivity or relative proportions of diffuse and specular reflections 104, 108 may be varied based on the processing conditions of the reflective coating 100. The reflective coating 100 is substantially composed of a polymeric material. The polymeric material of the reflective coating 100 may include polyolefins including low density polyethylene (LDPE) and high-density polyethylene (HDPE), polypropolyene, polyacrylates, including polyethylene/methacrylate copolymers, polyesters, including polyethylene terepthalate (PET), and blends thereof. The polymeric material can be virgin, recycled, or blends thereof. The polymer can optionally include polymer additives such as pigments, dyes, UV stabilizers, optical brighteners, antioxidants, flame retardant agents, anti-microbial agents, and mixtures thereof. In some embodiments, the reflective coating 100 may also include dyes to color the light of the diffuse and specular reflections 104, 108. In various embodiments, the reflective coating 100 is food safe, scratch resistant, and/or stain resistant.

The reflective coating 100 may be applied to the liner 50 of the refrigeration appliance 10 in a variety of ways. In one embodiment, the reflective coating 100 may be laminated onto the liner 50. Lamination may be accomplished in both cold and hot embodiments. In cold lamination embodiments, the reflective coating 100 may be a sheet having a similar chemical composition to the liner 50 and with a pressure or non-pressure sensitive adhesive backing. In such an embodiment, the reflective coating 100 may be applied before or after thermoforming of the liner. In hot lamination embodiments, the reflective coating 100 may be applied as a cap layer to the liner 50 while the liner is being extruded. Additionally, the cap layer may be applied to the both sides of the liner 50, or door liner 54, while it is being extruded. In other embodiments, the reflective coating 100 may be a film which is applied to the liner 50 prior to thermoforming, such that the heat of the thermoforming process binds the reflective coating 100 to the liner 50. Additionally, the film of reflective coating 100 may be independently heated and laminated to the liner 50. In other embodiments, the reflective coating 50 may be spray coated on the liner 50, before and/or after thermoforming of the liner 50. Spray coating of the reflective coating 100 onto the liner 50 may result in a matte type appearance where diffuse reflection dominates specular. Lamination of a film to the liner 50 may result in a gloss appearance where specular reflection dominates diffuse reflection. It should be understood that while the application methods described above were explained in connection with the liner 50, these methods may be used in connection with any of the aforementioned surfaces within the refrigeration appliance 10 (e.g., shelves 60, door liners 54, door bins 72, and drawers 68) where applicable. Similarly, the cold lamination method may be applied to the shelves 60 in glass embodiments and the hot lamination method may be employed in embodiments where the shelves 60 are polymeric.

In an exemplary method, applying the reflective coating 100 to the liner 50 includes the steps of first extruding a polymeric material comprising a thermoplastic polymer. The polymeric material may be any of the materials mentioned above in connection with the liner 50 and may be extruded by conventional techniques for polymer processing. Next, the polymeric material is rolled into a substantially flat sheet to form the liner 50. Next, the reflective coating 100, while in a film state, is heated and applied to the liner 50. The reflective coating 100 may be heated to between 100° F. and 300° F. Next, the reflective coating 100 is bonded to at least one surface of the liner 50. As explained above, the reflective coating 100 may be applied to the liner 50 while the liner 50 is still heated due to the extrusion and/or rolling process or after the liner 50 has cooled. The temperatures of the pre-heated reflective coating 100 will depend on the temperature of the liner 50 post extrusion. The heating of the coating 100 in conjunction with the heat of the liner 50 promotes bonding between the coating 100 and at least one surface of the liner 50 as the two are joined. Finally, the liner 50 and coating 100 are thermoformed under heat and pressure to shape the liner 50 into the desired shape. The thermoforming process may be carried out at a temperature between about 300° F. and about 400° F., specifically between about 320° F. and about 360° F., and more specifically between about 330° F. and about 350° F. It is important to note that the reflectivity of the reflective coating 100 has a negligible (i.e. less than about 1%) decrease in reflectivity from the thermoforming process. Further, due to the change in geometry of the liner 50 during the thermoforming process, the thickness of the film will be altered and must be taken into account when determining the desired level of reflectivity for the liner 50. It should also be understood that thermoforming of the liner 50 may be performed after any of the other aforementioned reflective coating application techniques. For example, in embodiments where the reflective coating is applied as a cap layer to one or both sides of the liner 50, or door liner 54, the liner 50 or door liner 54 may be thermoformed post extrusion to form the desired shape.

Figure 3B:
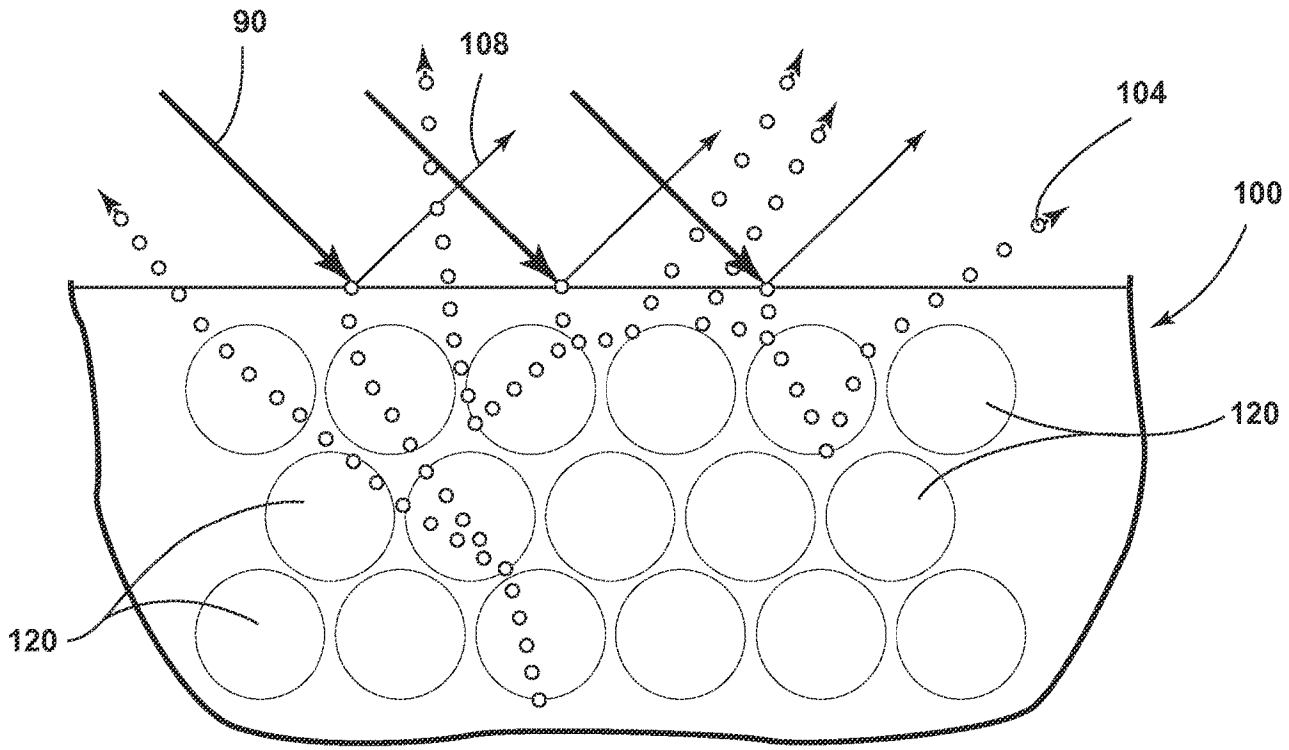
FIG. 3B is an enlarged view of FIG. 3A according to one embodiment.

Referring now to FIG. 3B, according to one embodiment, the reflective coating 100 includes a plurality of microcrystalline structures 120. In the depicted embodiment, the microcrystalline structures 120 are generally spherical, but may take a variety of shapes. For example, the microcrystalline structures 120 may be generally pyramidal, cubic, conic, triangular, cylindrical, prismatic, or irregular shapes thereof. The microcrystalline structures 120 in the depicted embodiment are a single uniform size, but in other embodiments, may have range of diameters or largest dimensions. In one embodiment, the microcrystalline structures 120 may range from about 0.1 μm to 300.0 μm. In another embodiment, the microcrystalline structures 120 may range from about 1.0 μm to about 100.0 μm. In a further embodiment, the microcrystalline structures 120 may range in size from about 5.0 μm to about 20.0 μm. In an additional embodiment, the microcrystalline structures 120 may range in size from about 0.1 μm to about 5.0 μm. The density, or how closely the microcrystalline structures 120 are packed, may affect the optical properties of the reflective coating 100 and is therefore variable, as well as variable across the coating 100. Although depicted in one uniform arrangement, the microcrystalline structures 120 are capable of many arrangements, including a stacked arrangement and a random arrangement. Additionally, the size, shape and level of discreteness of the microcrystalline structures 120 may vary across the coating 100. It is contemplated that the microcrystalline structures 120 may be replaced with air bubbles of comparable size and shape as the microcrystalline structures 120 without departing from the spirit of this disclosure. The microcrystalline structures 120 may be comprised of a polymer or amorphous material and distributed within the reflective coating 100. The microcrystalline structures 120 may be hollow or semi-hollow Referring again to FIG. 3B, as the light rays 90 contact a surface of the reflective coating 100, a portion of the light rays 90 are reflected as specular reflection 108, while another portion penetrates the reflective coating 100. As the light rays 90 travel through the reflective coating 100, the light rays 90 encounter the microcrystalline structures 120. A mismatch between the refractive index of the polymer of the reflective coating 100 and the refractive index of the polymer of the microcrystalline structures 120, in addition to the geometry of the microcrystalline structures 120, is believed to aid in scattering of light rays 90. As the light rays 90 contact the microcrystalline structures 120, portions of the light rays 90 are deflected and reflected, as illustrated. Due to the shape of microcrystalline structures 120, the reflected light rays 90 typically do not leave the reflective coating 100 in the same location as they entered. Similarly, the path of the deflected light rays 90 may change multiple times as the rays 90 pass through the microcrystalline structures 120, causing the rays 90 to exit the reflective coating 100 at different locations than the rays 90 entered. The net effect of the reflection and deflection of the light rays 90 off of the microcrystalline structures 120 is a random generation of secondary emissions leading to the diffuse reflection 104. It should be understood that embodiments utilizing air bubbles may lead to scattering of the light rays 90 in a substantially similar manner to that described in connection with the microcrystalline structures 120.

For more information regarding specifics of a reflective coating 100, see U.S. Pat. No. 8,734,940 to Teather et al., entitled "DIFFUSIVELY LIGHT REFLECTIVE PAINT COMPOSITION, METHOD FOR MAKING PAINT COMPOSITION, AND DIFFUSIVELY LIGHT REFLECTIVE ARTICLES," published May 27, 2014; U.S. Pat. No. 8,517,570 to Teather et al., entitled "DIFFUSIVELY LIGHT REFLECTIVE PAINT COMPOSITION, METHOD FOR MAKING PAINT COMPOSITION, AND DIFFUSIVELY LIGHT REFLECTIVE ARTICLES," published Jan. 29, 2013; U.S. Pat. No. 8,361,611 to Teather, entitled "DIFFUSIVE LIGHT REFLECTORS WITH POLYMERIC COATING AND OPAQUE BLACKOUT LAYER," published Aug. 27, 2013; U.S. patent application Ser. No. 12/506,915 to Purchase et al., entitled "OPTICAL DIFFUSERS WITH SPATIAL VARIATIONS," filed Feb. 18, 2010; U.S. patent application Ser. No. 12/249,557 to Wood et al., entitled "LIGHT MANAGEMENT FILMS, BACK LIGHT UNITS, AND RELATED STRUCTURES," filed Apr. 16, 2009, which are each incorporated herein by reference in their entirety as if fully set forth herein.

It should be understood that the reflective coating 100 is capable of utilization in more than just refrigeration appliances (e.g., refrigeration appliance 10). The reflective coating 100 may also be used in other household and commercial appliances and accessories. For example, the reflective coating 100 may be applied to interior surface of microwave appliances, interior surface of cooking appliances (e.g., an oven or a toaster oven), interior surface of fabric care appliances, range hoods, or any other appliance.

Figure 4:
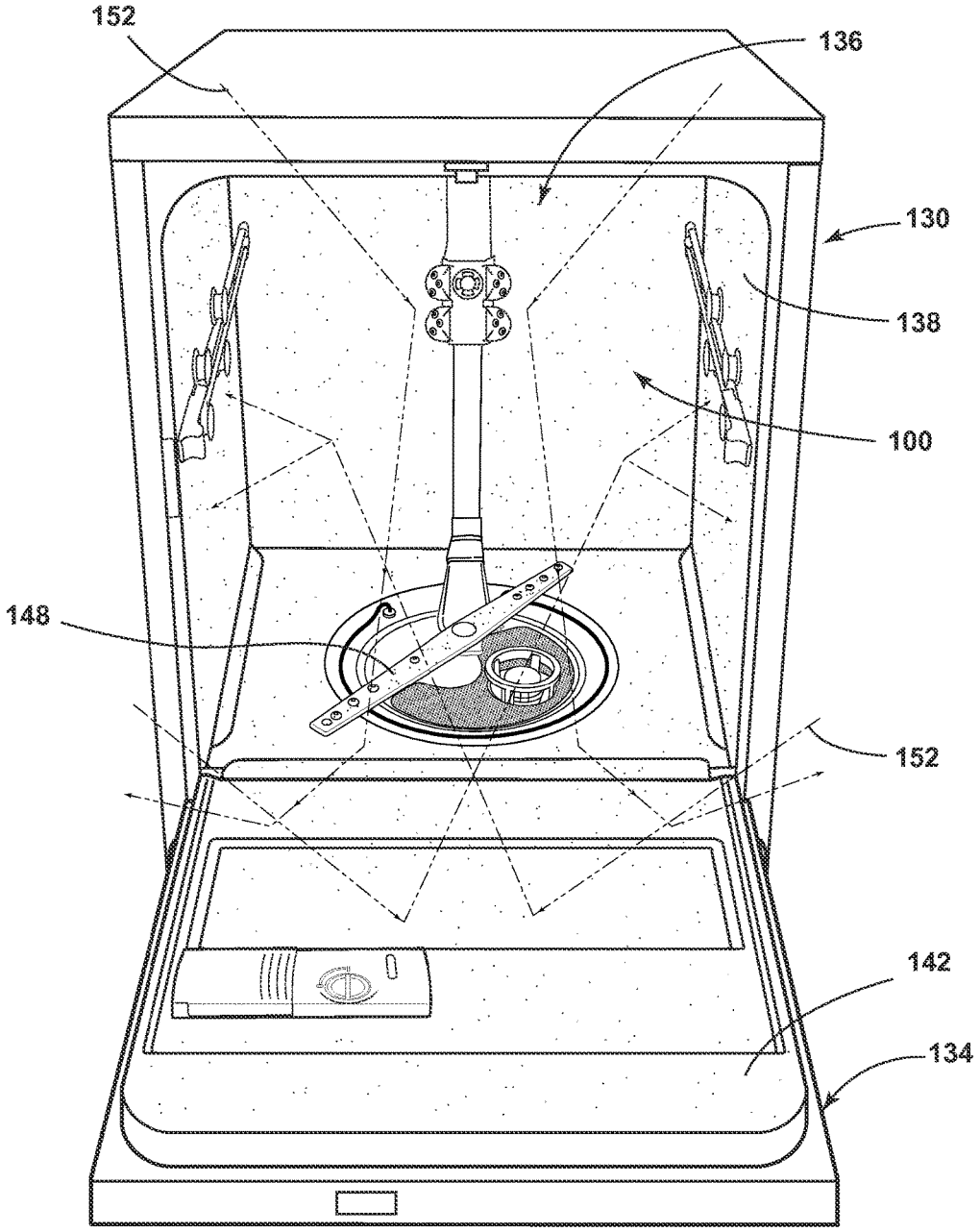
FIG. 4 is a front perspective view of an appliance according to another embodiment.

Referring now to FIG. 4, the reflective coating 100 is depicted as disposed within in a dishwashing appliance 130. In such an embodiment, the dishwashing appliance 130 has a door 134 operable between substantially open and substantially closed (not shown) positions providing access to a dishwashing compartment 136. The dish washing compartment 136 has an inner liner 138 and the door 134 has a door liner 142. Similarly to the refrigeration appliance 10, the reflective coating 100 may be applied to the inner liner 138 and the door liner 142, or any combination thereof. The depicted dishwashing appliance 130 also includes a sprayer arm 148 disposed within the dishwashing compartment 136 on which the reflective coating 100 may be applied.

Typically, while the dishwashing appliance of the present disclosure may include one or more light sources, dishwashing appliances typically do not have light sources located within them and can therefore appear dimly lit under certain lighting circumstances. Accordingly, it is advantageous to apply the reflective coating 100 in the dishwashing appliance 130 in order to maximize the use of ambient light rays 152 that enter the dishwashing compartment 136. As depicted, when the door 134 is in the substantially open position, ambient light rays 152 may enter the dishwashing compartment 136 either directly or may be reflected off of the reflective coating 100 on the door liner 142. Once inside the dishwashing appliance 130, the ambient light rays 152 are reflected off of the reflective coating 100 in a substantially similar manner as described above in connection with the refrigeration appliance 10. As stated above, the diffuse reflection 104 helps increase the scattering of light, as well as the number of reflections, in order to provide greater illumination to the dishwashing compartment 136. It should be understood that the embodiments of the dishwashing appliance 130 incorporating a light source similar to that of the refrigeration appliance 10 may also utilize the reflective coating 100.

It will be understood by one having ordinary skill in the art that construction of the described disclosure and other components is not limited to any specific material. Other exemplary embodiments disclosed herein may be formed from a wide variety of materials, unless described otherwise herein. In this specification and the amended claims, the singular forms "a," "an," and "the" include plural reference unless the context clearly dictates otherwise.

Where a range of values is provided, it is understood that each intervening value, to the tenth of the unit of the lower limit unless the context clearly dictates otherwise, between the upper and lower limit of that range, and any other stated or intervening value in that stated range, is encompassed within the disclosure. The upper and lower limits of these smaller ranges may independently be included in the smaller ranges, and are also encompassed within the disclosure, subject to any specifically excluded limit in the stated range. Where the stated range includes one or both of the limits, ranges excluding either or both of those included limits are also included in the disclosure.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present innovation, and further it is to be understood that such concepts are intended to be covered by the following claims unless these claims by their language expressly state otherwise.

What is claimed is:

1. A refrigeration appliance comprising:

a cabinet defining a refrigeration compartment;

a thermoformed inner liner disposed within the refrigeration compartment;

a light source located within the refrigeration compartment and configured to emit light such that the refrigeration compartment is illuminated when the light source is powered; and a reflective surface of the thermoformed liner comprising a plurality of microcrystalline structures and positioned to reflect emitted light from the light source and ambient light.

2. The refrigeration appliance of claim 1, wherein the reflective surface is a coating comprising at least one polymeric material chosen from the group consisting of polyolefins, polystyrene, polypropolyene, polyacrylates, polyesters and blends thereof.

3. The refrigeration appliance of claim 2, the refrigeration appliance further comprising:

a compartment having no light source; and a compartment liner disposed within the compartment having a reflective coating configured to reflect light contacting the reflective coating as diffuse reflected light where multiple emissions exit the reflective coating in random directions, wherein an interior of the compartment is illuminated solely via the diffuse reflected light.

4. The refrigeration appliance of claim 3, wherein the reflective coating has a reflectivity greater than about 95% of light having a wavelength between 400 nm and 700 nm.

5. The refrigeration appliance of claim 1, wherein the reflective surface is a layer disposed on an inner facing surface of the thermoformed inner liner.

6. The refrigeration appliance of claim 5, wherein the reflective surface has a reflectivity greater than about 90% and the reflective surface substantially reflects light between 400 nm and 700 nm, but does not substantially reflect light below 400 nm.

7. The refrigeration appliance of claim 1, wherein the reflective surface is configured to reflect greater than about 90% of the emitted light as diffuse reflected light where the reflection results in multiple secondary emissions exiting the reflective surface in random directions.

* * * * *